United States Patent [19]

Ebi et al.

[11] 4,166,691

[45] Sep. 4, 1979

[54] RECORDING SYSTEM

[75] Inventors: Yutaka Ebi, Kawasaki; Tositaka Hirata, Tokyo; Toshifumi Kato, Tokyo; Yohei Ikezu, Tokyo, all of Japan

[73] Assignee: Ricoh Company, Ltd., Japan

[21] Appl. No.: 931,130

[22] Filed: Aug. 4, 1978

[30] Foreign Application Priority Data

Aug. 10, 1977 [JP] Japan ..... 52-96272

[51] Int. Cl.[2] ..... G03G 15/00

[52] U.S. Cl. ..... 355/11; 118/653; 355/3 TR; 355/3 DD

[58] Field of Search ..... 355/11, 3 DD, 3 R, 3 TR, 355/14; 96/1.4; 118/647-651, 653-658

[56] References Cited

U.S. PATENT DOCUMENTS

| | | | |
|---|---|---|---|
| 3,117,884 | 1/1964 | Greig | 118/649 X |
| 3,999,849 | 12/1976 | Maksymiak et al. | 355/3 DD |

*Primary Examiner*—R. L. Moses

*Attorney, Agent, or Firm*—McGlew and Tuttle

[57] ABSTRACT

An electrostatic latent image is formed on a photoconductive or dielectric image carrier by a technique in which the image carrier is charged and exposed utilizing the photoconductivity, or by a technique in which the surface of the image carrier is directly and selectively charged with a stylus or a pin tube. The latent image is either directly developed or subjected to reversal development to form a positive or a negative visual image on the carrier. The direct development or reversal development may utilize one of dual toners which are charged to opposite polarities in a selective manner, or may employ a single component powder toner which is forcedly charged to a given polarity. the positive or negative visual image is electrostatically transferred onto a record sheet. The polarity of the voltage utilized during the transfer is switched depending on the polarity to which the toner which forms the visual image to be transferred is charged.

23 Claims, 5 Drawing Figures

RECORDING SYSTEM

BACKGROUND OF THE INVENTION

The invention relates to a recording system and, more particularly, to a recording system of the type in which an electrostatic latent image is formed on a latent image carrier and is either developed or reversally developed to form a positive or a negative visual image thereon which is then transferred onto a record sheet.

A variety of recording systems are known in which an electrostatic latent image is formed on an image carrier and is converted into a visual image, thereby providing a recorded image. By way of example, they include Xerographic copying machine, facsimile receiving equipment having a recording stylus, and a copying machine which also serves as a facsimile equipment.

SUMMARY OF THE INVENTION

It is an object of the invention to provide a novel recording system of the described type.

The novelty of the recording system of the invention resides in the fact that the polarity of the voltage, which is used to transfer a visual image as it is formed by direct development or reversal development of an electrostatic latent image formed on a carrier in a suitable manner, is switched in accordance with the polarity to which the toner, which forms the visual image, is charged. The present invention finds application in a variety of apparatus including a copying machine, a facsimile equipment, a duplicating and facsimile equipment or the like. In particular, when the invention is used to record facsimile information on a facsimile equipment or a similar apparatus which also serves as a duplicating machine and incorporating CRT, OFT or LED array, the operating life of CRT, OFT or LED array can be increased, resulting in an increase in the operating life of the entire apparatus.

DESCRIPTION OF PREFERRED EMBODIMENTS

Figure 1:
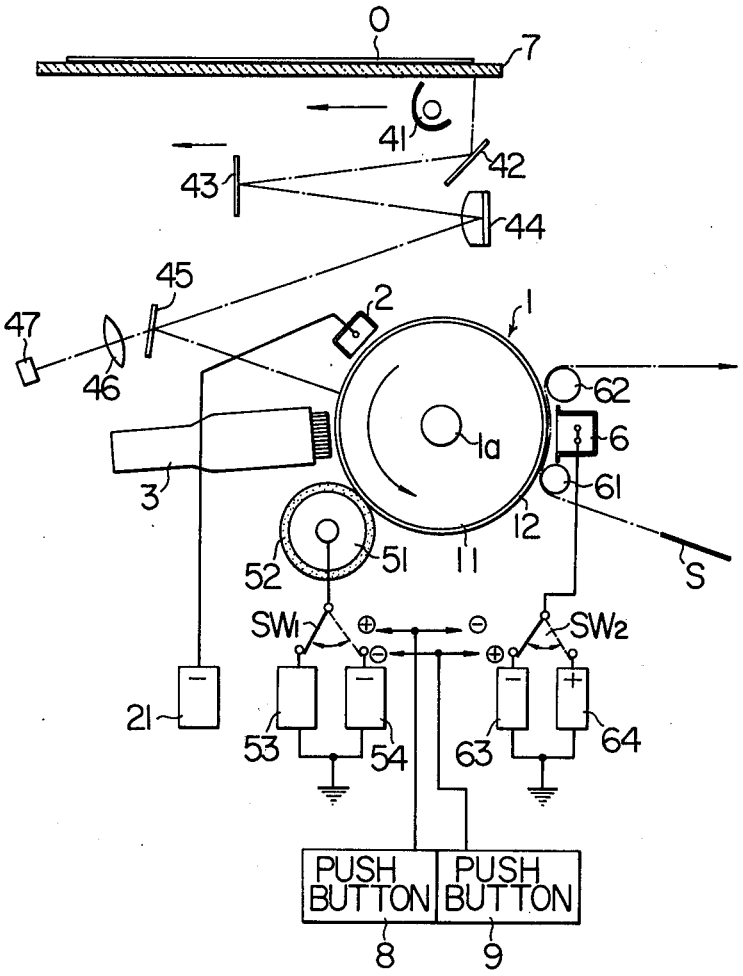
FIG. 1 is a schematic front view, illustrating the essential features of one embodiment of the invention.

Referring to FIG. 1, there is shown photosensitive body 1 which represents a latent image carrier, around which corona charger 2 and OFT 3 are sequentially disposed. Lamp 41 which represents a light source is disposed over the carrier 1 and is associated with a pair of reflecting mirrors 42, 43, in-mirror-lens 44, half mirror 45 and focussing lens system 46 which is associated with image sensor 47. Developing roller 51 is located forwardly of OFT as viewed in the direction of rotation of carrier 1, and carries developer 52 thereon. Transfer charger 6 is disposed intermediate developing roller and corona charger 2, and record sheet S is passed over the transfer charger. Numeral 7 represents a glass plate on which an original to be reproduced is placed. A source of negative d.c. voltage 21 is connected with corona charger 2 to cause a discharger thereof while developing roller 51 is selectively connected with sources of d.c. voltages 53, 54 through changeover switch SW1. The transfer charger 6 is also selectively connected with sources of d.c. voltages 63, 64 through another changeover switch SW2, and is associated with guide rollers 61, 62 to pass the record sheet therearound.

The photosensitive body 1 comprises an electrically conductive drum 11 which peripherally carries photoconductive layer 12 and which is rotatably mounted on shaft 1*a* so as to be rotatable in a direction indicated by arrow. To facilitate the understanding of the invention, photoconductive layer 12 is assumed to be formed by organic photosensitive resin (OPC).

Lamp 41, reflecting mirrors 42, 43, in-mirror-lens 44 and half mirror 45 constitute together an exposure optical system, which is combined with focussing lens system 46 to form an optical system which reads an original.

Optical fiber tube (OFT) 3 comprises a bundle of optical fibers which forms a screen elongate in a direction perpendicular to the plane of the drawing, the rear end face of optical fibers being covered with a fluorescent film to form an electronic scanning tube. The screen or so-called faceplate is disposed very close to the periphery of body 1 in parallel relationship with shaft 1*a*.

By switching the changeover switch SW1, a bias voltage, which is suitable for direct development or reversal development, can be selectively applied to developing roller 51. Similarly, switch SW2 can be switched to change the polarity of the discharge voltage applied to transfer charger 6. The switching operation of changeover switches SW1, SW2 takes place by using pushbuttons 8, 9, respectively. When either pushbutton is depressed, the changeover switches SW1, SW2 can be switched in ganged relationship.

When the described apparatus is used as a copying machine, a user depresses pushbutton 8 to switch changeover switches SW1, SW2 so that developing roller 51 is connected with source 53 and transfer charger 6 is connected with source 63. An original O to be copied is placed on top of glass plate 7. When the power is turned on, photosensitive member 1 initiates its rotation in the direction indicated by arrow, and corona charger 2 discharges to provide a blanket charging of the peripheral surface thereof. Usually a discharge voltage on the order of −5.6 kV is applied to charger 2 to charge the surface of photosensitive member 1 to a surface potential on the order of −1000 V.

In the meantime, lamp 41 illuminates and, when a charged surface region of photosensitive body reaches an exposure station, lamp 41 and reflecting mirror 42 move integrally in a direction indicated by arrow at a speed which is equal to the peripheral speed of the photosensitive body, thus scanning the original O. Simultaneously, the reflecting mirror 43 moves at a speed which is one-half that of the reflecting mirror 42, maintaining the length of the optical path of the exposure system constant. Reflective light from an illuminated area of the original O is introduced to the exposure station, that is, to a region between the corona charger 2 and OFT 3 where the image is focussed by the action of the in-mirror-lens 44, thus providing a so-called slitwise exposure of the photosensitive body 1. In this manner, an electrostatic latent image corresponding to the original O is formed on the photosensitive member 1.

Figure 2I:
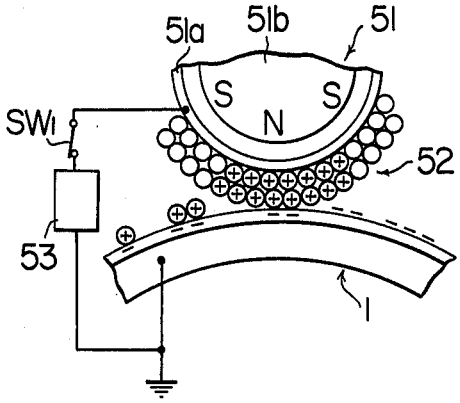
FIGS. 2 (I) and (II) illustrate respectively a modification of a manner of development which can be used in the reduction to practice of the described invention.
Figure 2:
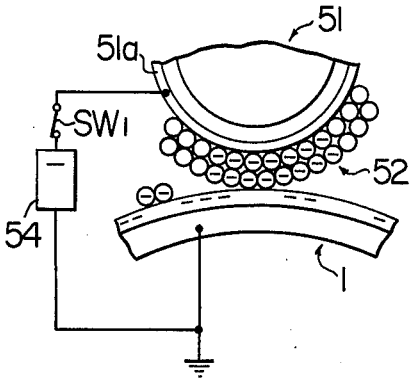

This latent image is developed by the developing unit. In the example shown, the roller 51 comprises an electrically conductive sleeve 51*a*, and a magnet roller 51*b* which is mounted internally of the sleeve 51*a*, as shown in FIG. 2. Developer 52 comprises one-component powder toner which is magnetically activated and which is magnetically retained on the sleeve 51*a* under the magnetic influence of magnet roller 51*b*. The one-component powder toner 52 is prepared to exhibit a volume resistance on the order of $10^{10}$ to $10^{14}$ Ωcm.

In the copy mode which is now in consideration, the developing roller 51 is connected with the source 53 which applies a negative potential of the same order as the surface potential of the background of latent image. However, it is to be noted that the developing roller 51 may be connected with the ground without using the source 53. Where the magent roller 51*b* produces a magnetic flux of high intensity, a positive bias potential may be applied to the developing roller 51*b*. The developing process takes place principally by the Coulomb force acting between the charge of a latent image and a positive charge which is opposite to the polarity of the latent image and which is introduced into the developer 52 by the electrostatic induction by the latent image. Thus, individual particles of the powder toner 52, which converts the latent image into a visual image, is charged to the positive polarity. See FIG. 3 (I). The positive charge is introduced into the toner by the difference between the negative potential applied by the source 53 and the negative potential in the image regions of the latent image.

Returning to FIG. 1, a visual image which is formed on the photosensitive member 1 by the developing step is transferred onto a record sheet S by means of the transfer unit. The record sheet S is fed into the transfer station, that is, into the clearance between the photosensitive member 1 and the transfer charger 6 in synchronized relationship with the movement of the visual image during the rotation of the photosensitive member 1 so that it can be brought into overlapping relationship with the visual image. The source 63 applies a discharge voltage on the order of −5.5 kV to the transfer charger 6, which produces a corona discharge to apply a negative charge to the rear surface of the record sheet S. In this manner, a visual image is electrostatically transferred onto the front surface of the record sheet S which is passed over the guide rollers 61, 62.

After the transfer step, the record sheet S is separated from the peripheral surface of the photosensitive member 1 and has its visual image fixed by a fixing unit, not shown, before it is delivered to the exterior of the apparatus. Thus a copy of the original O is obtained. Any suitable fixing technique may be employed. After the transfer step, the photosensitive member 1 has its charge eliminated by a neutralizer, not shown, and any residual toner is removed by a cleaning unit, not shown. This completes one cycle of the copying operation.

The same apparatus can be used as an original reader associated with a facsimile equipment. In this instance, only the exposure system and solid state image sensor 47 are activated while other components remain inoperative. Half mirror 45 is moved out of the optical path of the exposure system. The solid state image sensor 47 comprises an aligned array of very fine light receiving elements which are disposed in close succession, and has a self-scanning capability. The array is oriented in a direction perpendicular to the plane of the drawing, as viewed in FIG. 1, and is fixedly located. Upon the illumination lamp 41, reflective light from the original O is led onto the light receiving area of the image sensor 47 through the reflecting mirros 42, 43, in-mirror-lens 44 and focussing lens system 46, whereby a reduced image of rectilinear portion of an illuminated area of the original O is focussed onto the light receiving region. When the image sensor 47 is energized under this condition, the self-scanning mechanism operates to convert graphic information of the rectilinear portion into a train of electrical signals. By repeating the self-scanning operation of the image sensor 47 at a high speed while scanning the original O with the lamp 41, the graphic information of the original O is sequentially read and converted into a series of trains of electrical signals, thus providing sequential outputs. These electrical signals are processed in a suitable manner for telephotographic transmission.

If the half-mirror 45 is disposed in the optical path of the exposure system and the image sensor 47 is energized while conducting the described copying process, it is possible to read the original O to achieve a telephotographic transmission of corresponding information while performing a copying operation for the original O.

The described apparatus can also be used as a receiver unit of a facsimile equipment. In this instance, the exposure system is deactivated while the remainder of the apparatus is operated. An operator intially depresses the pushbutton 9 to throw the switches SW1, SW2 to be connected with the sources 54, 64. Consequently, a negative voltage is applied to the developing roller 51 while a positive voltage is applied to the transfer charger 6. In response to a signal from the transmitting end, the photosensitive body 1 is rotated in the direction of arrow, and the corona charger 2 is simultaneously operated to discharge, thus providing a blanket charging of the peripheral surface thereof to the negative polarity. At the same time, an electron beam is emitted from an electron gun of OFT 3, and the emission is allowed to become stable. When the emission of the electron beam is stable, a receive ready signal is set to the transmitting end.

In response thereto, the transmitting end transmits information signal, which is applied to OFT 3 to modulate the intensity of the electron beam which is emitted from the electron gun. The electron beam is deflected in the vertical direction, as viewed in FIG. 1, with a given period, by a deflection magnet, not shown. When the electron beam impinges upon fluorescent film located on the inside of the faceplate of OFT 3, scintillation occurs in the corresponding area. As a consequence, information signal which is applied to OFT 3 as a time varying signal is converted into a spatial distribution of light by the scintillation process which occurs on the fluorescent film. The scintillation is conducted to the front side of the faceplate through optical fibers, and is projected onto the peripheral surface of the photosensitive body 1 through a very small clearance. In this manner, the photosensitive member 1 is exposed by scintillation photon which occurs in response to individual information signals, thus forming an electrostatic latent image thereon.

It will be noted that information signal comprises an assembly of background signals and image signals which correspond to the background and the image regions, respectively. As a consequence, scintillation my be produced in response to the information signal in two manners, namely, in response to the background signal or alternatively in response to the image signal. When scintillation is produced in response to the background signal, the electrostatic image formed on the photosensitive member is a positive image, which can be developed in an ordinary manner to provide a positive, visual image. However, the resulting visual image is of an image quality which is less than satisfactory.

On the other hand, when scintillation is produced in response to the image signal, the resulting latent image formed on the photosensitive body is a negative image, which must be subjected to a reversal development in order to provide a positive, visual image. As recognized, the resulting positive, visual image which is obtained by the reversal development is of a higher image quality than the positive, visual image obtained through the ordinary development process.

The apparatus of the invention is capable of performing a reversal development, and hence is adaptable with the technique in which scintillation is produced in response to the image signal, thus assuring a facsimile recording of a satisfactory image quality. It should also be noted that background information represents an overwhelming majority of image information, so that causing scintillation in response to image signal produces a frequency of scintillation which is very much reduced than the frequency of scintillation that is procuded in response to background information. In other words, the wear of fluorescent film which occurs as a result of scintillation is reduced. As a consequence, where the reversal development is employed in the present invention, the operating life of the fluorescent film or OFT 3 can be drastically increased. Stated differently, the operating life of a recording system of the type using an electron scanning tube can be increased in accordance with the invention.

A negative latent image formed on the photosensitive member 1 by OFT 3, which produces scintillation in response to the image signal, is subjected to a reversal development, as illustrated in FIG. 2 (II). At this time, the developing roller 51 is connected, through the switch SW1, with the source 54 which applies a voltage on the order of −900 V. The one-component powder toner 52 obtains a negative charge of the same polarity as the negative latent image, and the electrical interaction between this negative charge and the charge of the electrostatic latent image effects a reversal development.

When the one-component powder toner is used to record an image which is subsequently transferred, the toner must exhibit a high resistance on the order of $10^{10}$ to $10^{14}$ Ωcm. It has been considered that such high resistance renders it difficult to achieve a development process by the injection of charge under the bias voltage. However, by experience, it is found that such developing technique is fully possible, assuring a satisfactory image quality when either normal development or reversal development is employed.

A visual image which is formed on the photosensitive body through the reversal development process represents a positive image with respect to the original image, which is to be reproduced, but represents a negative image with respect to the electrostatic latent image. Therefore, it will be referred to as a negative, visual image. That is to say, a negative visual image refers to a visual image which is produced by the reversal development process. By contrast, a visual image which is produced by the normal development process may be referred to as a positive, visual image.

The negative, visual image is electrostatically transferred onto a record sheet S in the same manner as mentioned before. At this time, a discharge voltage on the order of +5.5 kV is applied from the source 64 to the transfer charger 6. Thus, the polarity of transfer voltage is opposite from that used in the transfer of the positive, visual image in the described copying process. It is a feature of the invention that the polarity of discharge voltage applied to the transfer charger 6 is changed to be opposite from the polarity of the toner as the polarity of the toner changes in accordance with whether the direct development or reversal development is employed. Subsequent to the transfer step, the record sheet is processed in the similar manner as mentioned above. In this manner, a record of facsimile signal received can be made.

It will be noted that if the half mirror 45 is moved out of the optical path of the exposure system, it is possible to effect a reading and a telephotographic transmission of the original O and a recording of facsimile being received simultaneously. The facsimile receive mode can be provided as a printer process. Alternatively, the apparatus can be used as an output device of a computer.

In addition, by depressing the push-button 9 to establish a reversal development mode when conducting a copying process, a negative, inverted image of the original can be obtained as a copy. Such a copying process will be convenient where the original is a blue print.

Several modifications of the above embodiment will be described below. OFT 3 may be replaced by a cathode ray tube (CRT), LED array or laser modulation unit. CRT has a faceplate which is formed by a clear glass and on the rear surface of which fluorescent film is formed, thus providing an electron scanning tube. When it is disposed so that the faceplate is close to or almost contacts the surface of the photosensitive body, the resolution may be degraded as a result of the thickness of the clear glass. Where a high resolution is required, it is necessary to provide a focussing optical system between the faceplate and the surface of the photosensitive body in order to conduct scintillation which occurs in the fluorescent film located on the rear surface of the faceplate to the surface of the photosensitive body for focussing an exposure purposes. A preferred focussing optical system is an array of convergent transmission members in which each of the convergent transmission members acts as a focussing lens system, and which is known as an exposure optical system of the copying machine.

The LED array comprises an array of very fine light emitting diodes which are disposed in alignment with a row and which are selectively energized in accordance with an input signal. Again the use of a focussing optical system is necessary where the light emitting surface of the array is not disposed in contact with the photosensitive body. The use of a focussing optical system is also effective where OFT 3 is employed.

A laser modulation unit provides an intensity modulation of laser beam with AO modulating element, for example, with the modulated primary beam being periodically deflected with a galvanometric mirror or the like. By deflecting the modulated beam to scan the photosensitive body, an electrostatic latent image corresponding to information signal can be formed thereon.

When such arrangement is utilized to make a record, the capability of forming a negative latent image on the photosensitive member which can be subjected to a reversal development process means that the life of fluorescent film of CRT can be drastically increased. It also increases the life the LED array, and also has a favorable influence upon the life of AO modulating element where a laser modulation unit is employed.

In the described arrangement, an exposure optical system has been used as means for forming a positive latent image. However, a stylus or pin tube may be used as alternative means to form a positive latent image.

A stylus is well-known is the art of facsimile receiving and recording equipment. It comprises an array of a number of stylus electrodes which are aligned in one direction in close succession. The end of stylus electrodes are embedded in a board, the end face of which is disposed in close proximity to the surface of the photosensitive body. In this instance, an electrostatic latent image is formed by a discharge of charge from a selected stylus electrode to the photosensitive body in accordance with information signal. Consequently, it is unnecessary to charge the photosensitive body by means of corona charger where a stylus is used to make a record.

A pin tube is an electron scanning tube having a faceplate in which conductive pins are fastened as insulated from each other. Electron is emitted from a pin in the region where an electron beam impinges. Consequently, an electrostatic latent image is formed in the similar manner as with the stylus. Again, it is unnecessary to charge the photosensitive body.

When the stylus or pin tube is used, it is quite free to choose either a positive latent image or a negative latent image which is formed in accordance with an information signal. Thus, a recording system which is provided with the stylus or pin tube alone as means for forming a latent image is also contemplated by the present invention. When such system is used as a copying machine, an original is read and subjected to photoelectric conversion to provide an electrical signal which is applied to the stylus or pin tube. In such system, the latent image carrier need not be photosensitive, the only requirement being that it is capable of retaining the electrostatic latent image. Thus a dielectric material may be used.

Figure 3I:
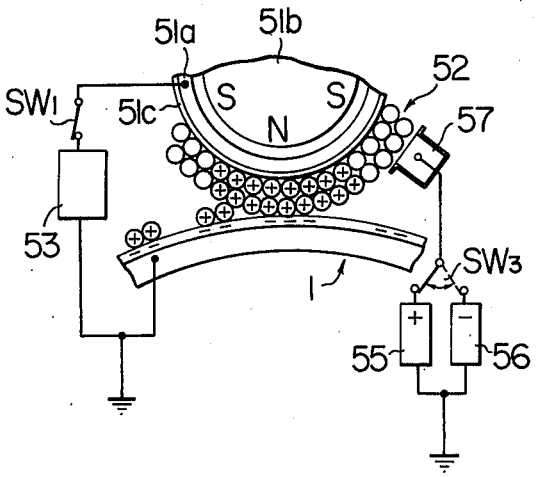
FIG. 3 (I) and 3 (II) illustrates respectively a modification of another manner of development which is also usable in the present invention.
Figure 3:
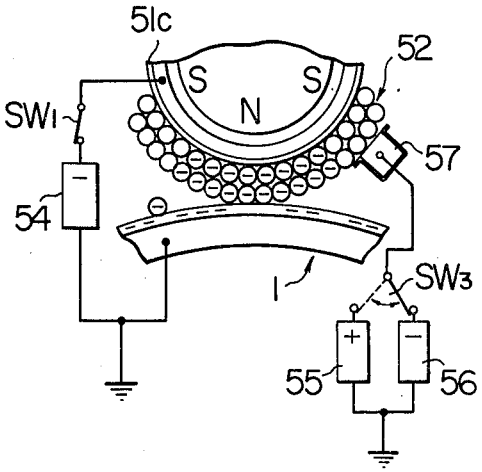

While in the above description, the latent image carrier has been assumed to be drum-shaped, it will be appreciated that the configuration of such carrier is not limited to drum configuration, but may have any desired configuration. In addition, the carrier may be formed of any known photoconductive material. The developing technique is not limited to the one illustrated above, but the invention is applicable to a variety of developing techniques. By way of example, the developer 52 may be forcedly charged by utilizing triboelectric charging or corona charging. FIG. 3 shows a specific example of such developing technique. Specifically, corona charger 57 forcedly charges the developer 52. The polarity to which it is charged is switched by the switch SW3 depending on either direct development or reversal development is employed. It should be understood that the switch SW3 is automatically operated as the pushbuttons 8, 9 (FIG. 1) are operated. FIG. 3 (I) illustrates a normal development process while FIG. 3 (II) illustrates a reversal development process. Sources of d.c. voltage 55, 56 may be independent from or common with the sources 63, 64 associated with the transfer charger 6. In this instance, the peripheral surface of the conductive sleeve **51*a* is coated with highly insulating thin dielectric layer 51*c*** without in any way detracting from the satisfactory achievement of development.

From the foregoing description, it will be appreciated that the invention has provided a novel recording system. It will be noted that in the arrangement FIG. 1, the half mirror 45 may be replaced by a plane mirror of usual construction, focussing lens system juxtaposed with the in-mirror-lens 44, and solid state image sensor 47 located on the same side of the reflecting mirror 43 as the in-mirror-lens 44. This eliminates the need to use a half mirror, thereby avoiding light loss which is involved with the use of a half mirror.

What is claimed is:

1. A recording apparatus comprising:

a carrier means capable of retaining a latent electrostatic image, means for forming a latent electrostatic image on said carrier means, developing means for dispensing a toner relative to said carrier means, said developing means including means for selectively changing the polarity of the toner so as to effect either a direct development or reversal development of the latent image on said carrier means, transfer means for electrostatically transferring the developed image onto a record sheet, said transfer means including means for changing the polarity of the voltage to said transfer means so that the polarity of the voltage to said transfer means is opposite to the polarity of the toner which forms the visual image being transferred.

2. A recording apparatus as defined in claim 1 wherein said carrier means comprises a photosensitive body which is photoconductive, means which exposes the photoconductive body, and said means for forming the electrostatic latent image including a corona charger which charges said photosensitive body.

3. A recording apparatus as defined in claim 1 wherein said carrier means comprises a photosensitive body which is photoconductive, and said means for forming the electrostatic latent image includes an optical fiber tube.

4. A recording apparatus as defined in claim 2 wherein said carrier means comprises a photosensitive body which is photoconductive and said means forming the electrostatic latent image including a cathode ray tube.

5. A recording apparatus as defined in claim 1 wherein said carrier means comprises a photosensitive body which is photoconductive and said means forming the electrostatic latent image including a LED array.

6. A recording apparatus as defined in claim 1 wherein said carrier means comprises a photosensitive body which is photoconductive and said means forming the electrostatic latent image including a laser modulation unit.

7. A recording apparatus as defined in claim 3 and including a focusing optical system between said optical fiber tube and said photosensitive body.

8. A recording apparatus as defined in claim 7 wherein said focusing optical system comprises an array of convergent transmission members.

9. A recording apparatus as defined in claim 1 wherein said carrier means includes a photosensitive body which is photoconductive, and said means for forming the electrostatic latent image being selected from the group consisting of an optical fiber tube, cathode ray tube, LED array laser modulating unit, a stylus, or pin tube.

10. A recording apparatus as defined in claim 9 and including a focusing optical system disposed between said photosensitive body and said means for forming said electrostatic latent image.

11. A recording system according to claim 2 in which said means which exposes the photosensitive body comprises an exposure optical system which projects a light image of an original onto the photosensitive body, and a laser modulation unit.

12. A recording apparatus as defined in claim 9 wherein said means which exposes the photosensitive body comprises an exposure optical system which projects light image of an original onto the photosensitive body.

13. A recording apparatus as defined in claim 10 wherein said focusing optical system includes an array of convergent light transmission members.

14. A recording system according to claim 1 in which the carrier is a photosensitive body which is photoconductive, and said means for forming an electrostatic latent image comprises a corona charger which charges the photosensitive body, means which exposes the photosensitive body, and either a stylus or a pin tube.

15. A recording system according to claim 1 in which the carrier comprises a dielectric material, and said means for forming an electrostatic latent image comprises a stylus or a pin tube.

16. A recording apparatus according to claim 1 in which said developing means comprises a quantity of one-component powder toner having a volume resistance on the order of $10^{10}$ to $10^{15}$ Ωcm, and a conductive retainer which retains the toner thereon and carries it to a developing station, said retainer being either connected with the ground or associated with means which applies a bias voltage of either polarity thereto.

17. A recording apparatus according to claim 1 in which said developming means for developing the electrostatic latent image comprises a quantity of one-componenet powder toner of a high electrical resistance, a retainer which retains the toner thereon and carries it to a developing station, and means for forcedly charging the toner retained and carried by the retainer to either positive or negative polarity.

18. A recording apparatus according to claim 17 in which said charging means comprises a corona charger.

19. A recording apparatus as defined in claim 18 and means for changing the polarity of said corona charger.

20. A recording apparatus as defined in claim 19 wherein said means for changing the polarity of said corona charger includes a D.C. negative voltage source and a D.C positive voltage source, and a switching means for selectively connecting one of said voltage sources to said corona charger.

21. A recording apparatus as defined in claim 10 wherein said carrier comprises a photosensitive body which is photoconductive, means which exposes the photosensitive body, said latter means including an exposure optical system which projects a light image of an original onto the photosensitive body.

22. A recording apparatus as defined in claim 21 wherein said optical system includes a half mirror and an image sensor disposed in the optical path of said half mirror for reading the original for telephotographic transmission.

23. A recording system comprising a latent image carrier, means for forming an electrostatic latent image on the carrier, developing means for selectively subjecting the latent image formed to a direct development or a reversal development process to produce a positive or a negative visual image, means for electrostatically transferring the positive or the negative visual image onto a record sheet, and means for switching the polarity of a transfer voltage to said transfer means so as to be opposite from the polarity to which a toner which forms the visual image being transferred is charged in accordance with the polarity of the toner charge.

* * * * *